US006179794B1

(12) United States Patent
Burras

(10) Patent No.: US 6,179,794 B1
(45) Date of Patent: Jan. 30, 2001

(54) ADJUSTABLE VIBRATING HEAD MASSAGING DEVICE

(76) Inventor: Jon Burras, 18411 Hatteras St. #149, Tarzana, CA (US) 91356

( * ) Notice: Under 35 U.S.C. 154(b), the term of this patent shall be extended for 0 days.

(21) Appl. No.: 09/195,974

(22) Filed: Nov. 19, 1998

(51) Int. Cl.[7] ..... A61H 1/00
(52) U.S. Cl. ..... 601/79; 601/46
(58) Field of Search ..... 601/46, 47, 79, 601/89, 67, 68, 69, 70, 71, 81, 84, 143, 97, 95, 101, 103, 107, 111, 138; D24/200, 215; 128/857; 602/74

(56) References Cited

U.S. PATENT DOCUMENTS

D. 328,497 * 8/1992 Morrison et al. ..... D24/200
D. 368,141 * 3/1996 Rabin et al. ..... D24/215
D. 405,538 * 2/1999 Chih ..... D24/215
5,140,978 * 8/1992 Sirninger ..... 602/74
5,421,799 * 6/1995 Rabin et al. ..... 601/71
5,468,218 * 11/1995 Ward ..... 601/144
5,611,771 * 3/1997 Taylor ..... 601/70

* cited by examiner

*Primary Examiner*—Justine R. Yu

(57) ABSTRACT

A massaging head gear system is provided including a headband with a substantially inverted U-shaped configuration. Also included is a pair of massaging assemblies coupled to ends of the headband. Next provided is a vibrating mechanism for vibrating the massaging assemblies and the headband.

6 Claims, 2 Drawing Sheets

ADJUSTABLE VIBRATING HEAD MASSAGING DEVICE

BACKGROUND OF THE INVENTION

1. Field of the Invention

The present invention relates to head massagers and more particularly pertains to a new adjustable vibrating head massaging device for providing comfort and relief from headaches and the like.

2. Description of the Prior Art

The use of head massagers is known in the prior art. More specifically, head massagers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,421,799; U.S. Pat. No. 5,115,769; U.S. Pat. No. 5,569,166; U.S. Pat. No. 5,277,174; U.S. Pat. No. 3,478,736; and U.S. Pat. No. Des. 368,141.

In these respects, the adjustable vibrating head massaging device according to the present invention substantially departs from the conventional concepts and designs of the prior art, and in so doing provides an apparatus primarily developed for the purpose of providing comfort and relief from headaches and the like.

SUMMARY OF THE INVENTION

In view of the foregoing disadvantages inherent in the known types of head massagers now present in the prior art, the present invention provides a new adjustable vibrating head massaging device construction wherein the same can be utilized for providing comfort and relief from headaches and the like.

The general purpose of the present invention, which will be described subsequently in greater detail, is to provide a new adjustable vibrating head massaging device apparatus and method which has many of the advantages of the head massagers mentioned heretofore and many novel features that result in a new adjustable vibrating head massaging device which is not anticipated, rendered obvious, suggested, or even implied by any of the prior art head massagers, either alone or in any combination thereof.

To attain this, the present invention generally comprises an inverted U-shaped headband having a central housing with an arcuate bottom face, an arcuate top face, a pair of elongated side faces and a pair of short end faces. As such, an interior space is defined. The headband further includes a sleeve with a length greater than that of the central housing. A pair of ends of the sleeve extend from a pair of slots formed in the end faces of the central housing adjacent to the bottom face thereof. Note FIG. 3. Next provided is a pair of massaging assemblies each including an arcuate adjustment piece with a first end slidably positioned within an open end of one of the sleeves of the headband. As shown in FIGS. 2–4, a horizontal bracket is mounted to a second end of the adjustment piece. Further, a generally planar rectangular slider bar is slidably positioned within the horizontal bracket between opposite open ends thereof. For constraining sliding motion within the horizontal bracket, a center of a top edge and a bottom edge of the slider bar has a reduced width. In use, the slider bar moves along an axis perpendicular with respect to a plane in which the headband resides. Each of the massaging assemblies further includes a pair of pads. As shown in FIGS. 1, 4 and 5, each pad has a planar outer face and a planar inner face with a plurality of soft rubber nibs extending therefrom in perpendicular relationship therewith. Formed between the inner face and the outer face is a periphery which is defined by a pair of parallel linear side edges and a pair of semicircular end edges. A first one of the end edges of each pad is hollow for receiving one of the ends of the slider bar. As such, the pads of each massaging assembly pivot within a common plane that includes the slider piece. In other words, the pads pivot about axes which are parallel with the plane in which the headband resides. Finally, a vibrating mechanism is situated within the central housing of the headband. The vibrating mechanism is mounted on the sleeve for vibrating the headband and massaging assemblies upon the actuation thereof. Ideally, the vibrating mechanism includes a dial mounted on an upper apex of the top face of the central housing of the headband. Such dial is adapted for adjusting an extent to which the vibrating mechanism vibrates.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable vibrating head massaging device apparatus and method which has many of the advantages of the head massagers mentioned heretofore and many novel features that result in a new adjustable vibrating head massaging device which is not anticipated, rendered obvious, suggested, or even implied by any of the prior art head massagers, either alone or in any combination thereof.

It is another object of the present invention to provide a new adjustable vibrating head massaging device which may be easily and efficiently manufactured and marketed.

It is a further object of the present invention to provide a new adjustable vibrating head massaging device which is of a durable and reliable construction.

An even further object of the present invention is to provide a new adjustable vibrating head massaging device which is susceptible of a low cost of manufacture with regard to both materials and labor, and which accordingly is then susceptible of low prices of sale to the consuming public, thereby making such adjustable vibrating head massaging device economically available to the buying public.

Still yet another object of the present invention is to provide a new adjustable vibrating head massaging device which provides in the apparatuses and methods of the prior art some of the advantages thereof, while simultaneously overcoming some of the disadvantages normally associated therewith.

Still another object of the present invention is to provide a new adjustable vibrating head massaging device for providing comfort and relief from headaches and the like.

Even still another object of the present invention is to provide a new adjustable vibrating head massaging device that includes a headband with a substantially inverted U-shaped configuration. Also included is a pair of massaging assemblies coupled to ends of the headband. Next provided is a vibrating mechanism for vibrating the massaging assemblies and the headband.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
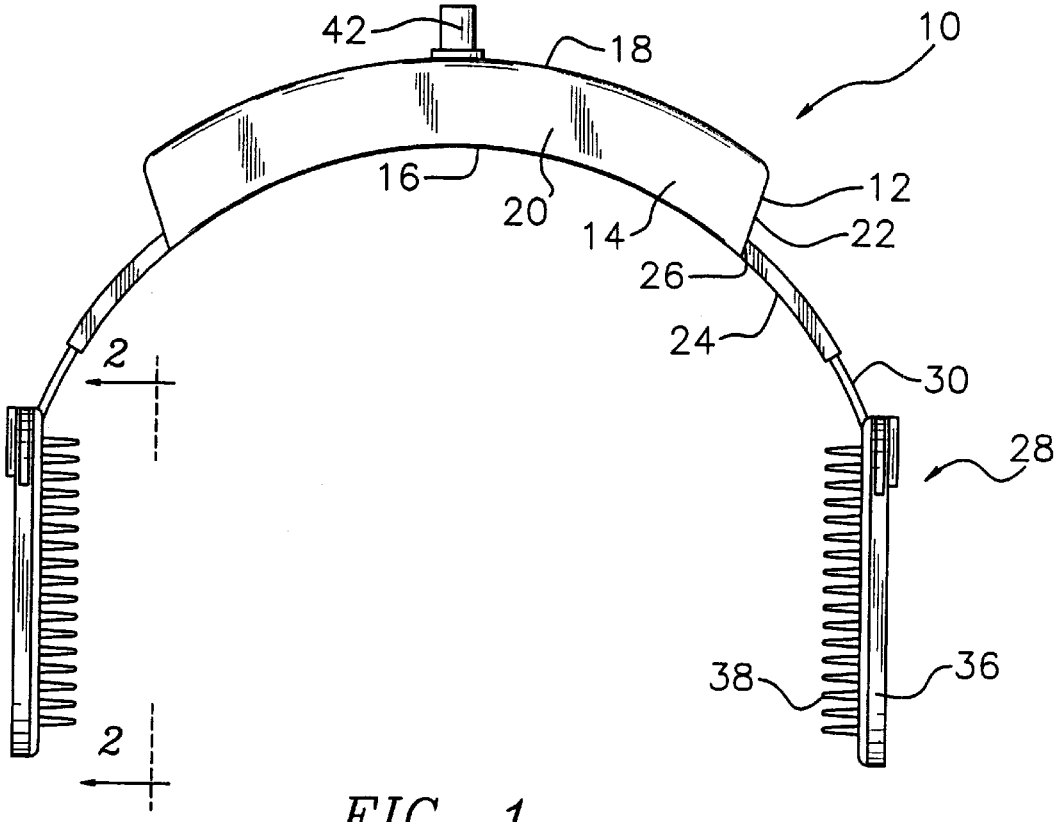
FIG. 1 is a front view of a new adjustable vibrating head massaging device according to the present invention.

With reference now to the drawings, and in particular to FIGS. 1 through 5 thereof, a new adjustable vibrating head massaging device embodying the principles and concepts of the present invention and generally designated by the reference numeral 10 will be described.

The present invention, designated as numeral 10, includes an inverted U-shaped headband 12 having a central housing 14 with an arcuate bottom face 16, an arcuate top face 18, a pair of elongated side faces 20 and a pair of short end faces 22. As such, an interior space is defined. The headband further includes a sleeve 24 with a length greater than that of the central housing, a width equal to that of the central housing, and a thickness less than ¼ that of the central housing. A pair of ends of the sleeve extend from a pair of slots 26 formed in the end faces of the central housing adjacent to the bottom face thereof. Note FIG. 3.

Figure 2:
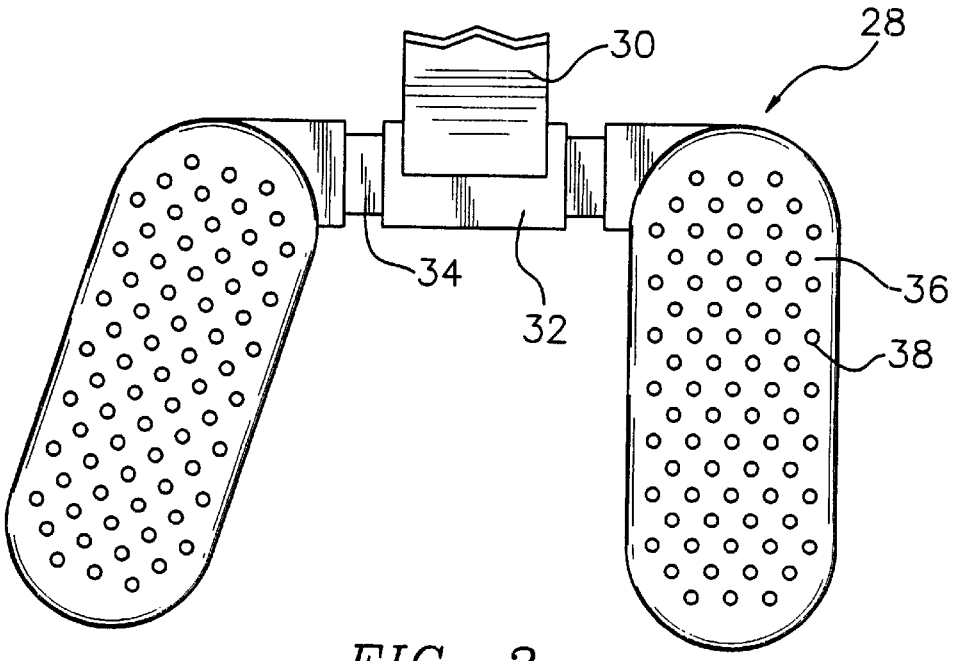
FIG. 2 is a side view of the pads of one of the massaging assemblies of the present invention.
Figure 3:
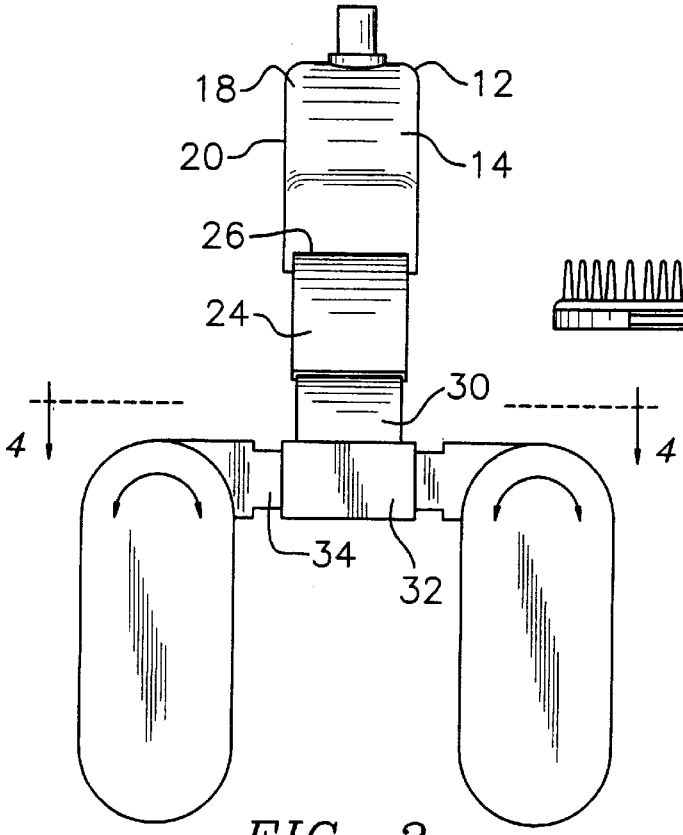
FIG. 3 is a side view of the present invention.
Figure 4:
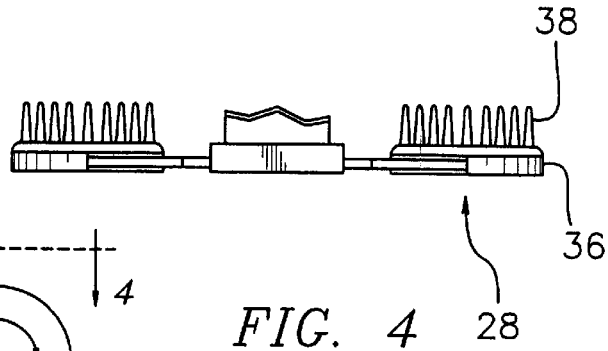
FIG. 4 is a top view of one of the massaging assemblies of the present invention.

Next provided is a pair of massaging assemblies 28 each including an arcuate adjustment piece 30 with a first end slidably positioned within an open end of one of the sleeves of the headband. It should be noted that the adjustment pieces each have a radius of curvature which is similar to that of the sleeves. As shown in FIGS. 2–4, a horizontal bracket 32 is mounted to a second end of each adjustment piece. The horizontal bracket essentially takes the form of a sleeve and has a length substantially equal or slightly greater than a width of the headband.

Yet another component of each massaging assembly is a generally planar rectangular slider bar 34 slidably positioned within the horizontal bracket between opposite open ends thereof. For constraining sliding motion within the horizontal bracket, a center of a top edge and a bottom edge of the slider bar has a reduced width. In use, the slider bar moves along an axis perpendicular with respect to a plane in which the headband resides. As an option, the slider bar may be divided into a pair of separate portions which may slide independent with respect to each other.

Figure 5:
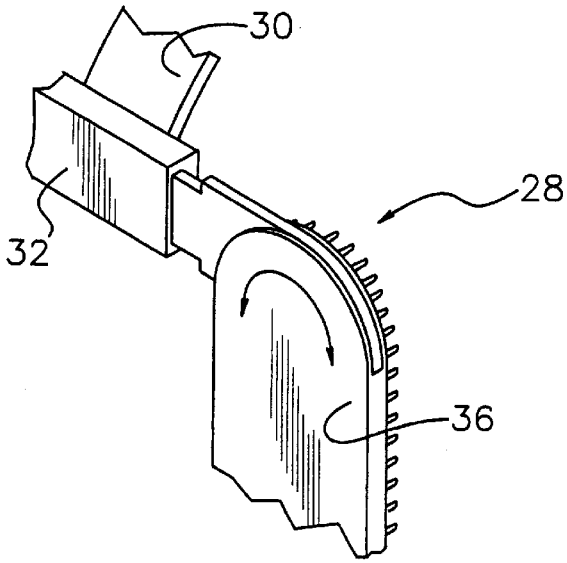
FIG. 5 is a perspective view of a pad of one of the massaging assemblies of the present invention.

Each of the massaging assemblies further includes a pair of pads 36. As shown in FIGS. 1, 4 and 5, each pad has a planar outer face and a planar inner face with a plurality of ½ inch soft rubber nibs 38 extending therefrom in perpendicular relationship therewith. Ideally, the entire inner face is equipped with such nibs. Formed between the inner face and the outer face is a periphery which is defined by a pair of parallel linear side edges and a pair of semicircular end edges. A first one of the end edges of each pad is hollow for receiving one of the ends of the associated slider bar. Ideally, an unillustrated post of the pad extends through an aperture formed in the slider bar. As such, the pads of each massaging assembly pivot within a common plane that includes the slider piece. In other words, the pads pivot about axes which are parallel with the plane in which the headband resides.

Finally, a battery powered vibrating mechanism is situated within the central housing of the headband. The vibrating mechanism is mounted on the sleeve for vibrating the headband and massaging assemblies upon the actuation thereof. Ideally, the vibrating mechanism includes a dial 42 mounted on an upper apex of the top face of the central housing of the headband. Such dial is adapted for adjusting an extent to which the vibrating mechanism vibrates. It should be noted that the vibrating mechanism may take the form of an eccentrically mounted weight or any other mechanism for affording the vibration feature set forth hereinabove.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A massaging head gear system comprising, in combination:

an inverted U-shaped headband including a central housing having an arcuate bottom face, an arcuate top face, a pair of elongated side faces and a pair of short end faces defining an interior space, a pair of slots formed in the end faces of the central housing adjacent to the bottom face thereof, the headband further including a sleeve with a length greater than that of the central housing with a pair of ends extending from the pair of slots;

a pair of laterally-spaced massaging assemblies each including an arcuate adjustment piece, the adjustment piece having a first end slidably positioned in an open end of the sleeve of the headband, a slider bracket being mounted to a second end of the adjustment piece, a generally planar rectangular slider bar mounted on the slider bracket between opposite open ends of the slider bracket with a top edge and a bottom edge, each of the massaging assembles comprising a pair of laterally-spaced pads depending from spaced locations on the slider bar for positioning a first one of the pair of pads in a location in front of an ear of the wearer and a second one of the pair of pads in a location behind the ear of the wearer with the ear positioned in between the pads, the slider bar being slidably mounted on the slider bracket for permitting movement of the slider bar and the pads mounted thereon along an axis oriented perpendicular to a plane in which the headband lies, each slider bar having a central extent with a reduced width for constraining sliding motion of the slider bar in the slider bracket, each pad having a planar outer face, a planar inner face with a plurality of soft nibs extending therefrom in perpendicular relationship with the inner face for extending between hairs on the head of wearer, and a periphery formed between the inner and outer faces, the periphery being defined by a pair of parallel linear side edges and a pair of semicircular end edges, wherein a first one of the end edges of each pad is hollow for receiving one of the ends of the slider bar, each of the pads being pivotally mounted on the slider bar in a manner such that the pad pivots in a plane that includes the slider bar; and a vibrating mechanism situated in the central housing of the headband and mounted on the sleeve for vibrating the headband and massaging assemblies upon the actuation thereof, the vibrating mechanism including a dial mounted on an upper apex of the top face of the central housing of the headband for adjusting an extent to which the vibrating mechanism vibrates.

2. A massaging head gear system comprising:

a headband with a substantially inverted U-shaped configuration, the headband having opposite ends;

a pair of laterally-spaced massaging assemblies coupled to the ends of the headband, a slider bracket being mounted to each of the ends of the headband, a slider bar being mounted on the slider bracket between opposite open ends of the slider bracket, each of the massaging assembles comprising a pair of laterally-spaced pads depending from spaced locations on the slider bar for positioning a first one of the pair of pads in a location in front of an ear of the wearer and a second one of the pair of pads in a location behind the ear of the wearer with the ear positioned in between the pads, the slider bar being slidably mounted on the slider bracket for permitting movement of the slider bar and the pads mounted thereon along an axis oriented perpendicular to a plane in which the headband lies, each pad having an outer face and an inner face with a periphery formed between the inner and outer faces, each of the pads being pivotally mounted on the slider bar in a manner such that the pad pivots in a plane that includes the slider bar; and a vibrating mechanism for vibrating the massaging assemblies.

3. A massaging head gear system as set forth in claim 2 wherein the vibrating mechanism is positioned on the headband and has an adjuster for allowing a user to adjust an extent to which the vibrating mechanism vibrates.

4. A massaging head gear system as set forth in claim 2 wherein the massaging assemblies include pads with nibs extending from the inner face of the pads in perpendicular relationship with the inner face for extending between hairs on the head of wearer.

5. A massaging head gear system as set forth in claim 2 wherein the massaging assemblies are adapted to be moved along an arcuate path defined by the headband.

6. A massaging head gear system comprising:

an inverted U-shaped headband including a sleeve with a pair of ends;

a pair of laterally-spaced massaging assemblies each including an arcuate adjustment piece, the adjustment piece having a first end slidably positioned in an open end of the sleeve of the headband, a slider bracket being mounted to a second end of the adjustment piece, a slider bar mounted on the slider bracket between opposite open ends of the slider bracket with a top edge and a bottom edge, each of the massaging assembles comprising a pair of laterally-spaced pads depending from spaced locations on the slider bar for positioning a first one of the pair of pads in a location in front of an ear of the wearer and a second one of the pair of pads in a location behind the ear of the wearer with the ear positioned in between the pads, the slider bar being slidably mounted on the slider bracket for permitting movement of the slider bar and the pads mounted thereon along an axis oriented perpendicular to a plane in which the headband lies, each slider bar having a central extent with a reduced width for constraining sliding motion of the slider bar in the slider bracket, each pad having a planar outer face, a planar inner face with a plurality of soft nibs extending therefrom in perpendicular relationship with the inner face for extending between hairs on the head of wearer, and a periphery formed between the inner and outer faces, the periphery being defined by a pair of parallel linear side edges and a pair of semicircular end edges, wherein a first one of the end edges of each pad is hollow for receiving one of the ends of the slider bar, each of the pads being pivotally mounted on the slider bar in a manner such that the pad pivots in a plane that includes the slider bar; and a vibrating mechanism mounted on the headband for vibrating massaging assemblies upon the actuation of the vibrating mechanism, the vibrating mechanism including a control mounted on the headband for adjusting an extent to which the vibrating mechanism vibrates.

* * * * *